US008451190B2

(12) United States Patent
Makarov et al.

(10) Patent No.: US 8,451,190 B2
(45) **Date of Patent: *May 28, 2013**

(54) NON-CUTOFF FREQUENCY SELECTIVE SURFACE GROUND PLANE ANTENNA ASSEMBLY

(75) Inventors: Sergey N. Makarov, Holden, MA (US); Francesca Scire-Scappuzzo, Lexington, MA (US)

(73) Assignee: Physical Sciences, Inc., Andover, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/182,263

(22) Filed: Jul. 13, 2011

(65) Prior Publication Data

US 2011/0267252 A1 Nov. 3, 2011

Related U.S. Application Data

(63) Continuation of application No. 12/212,065, filed on Sep. 17, 2008, now Pat. No. 8,004,474.

(60) Provisional application No. 60/973,025, filed on Sep. 17, 2007.

(51) Int. Cl.
*H01Q 15/02* (2006.01)

(52) U.S. Cl.
USPC ..... 343/909; 343/797; 343/840

(58) Field of Classification Search
USPC ..... 343/797, 840, 848, 909
See application file for complete search history.

(56) References Cited

U.S. PATENT DOCUMENTS

| | | | | |
|---|---|---|---|---|
| 3,701,157 | A | 10/1972 | Uhrig | |
| 4,161,736 | A | 7/1979 | Goodman | |
| 5,173,715 | A | 12/1992 | Rodal et al. | |
| 5,625,365 | A | 4/1997 | Tom et al. | |
| 5,650,792 | A | 7/1997 | Moore et al. | |
| 5,694,136 | A | 12/1997 | Westfall | |
| 5,986,615 | A | 11/1999 | Westfall et al. | |
| 6,040,805 | A | 3/2000 | Huynh et al. | |
| 6,278,407 | B1 | 8/2001 | Ashjaee et al. | |
| 6,816,123 | B2 | 11/2004 | Eom et al. | |
| 6,879,298 | B1 * | 4/2005 | Zarro et al. | 343/786 |
| 6,940,457 | B2 | 9/2005 | Lee et al. | |
| 8,004,474 | B2 * | 8/2011 | Makarov et al. | 343/909 |
| 2002/0011965 | A1 | 1/2002 | Kunysz | |

OTHER PUBLICATIONS

"Artificially Soft and Hard Surfaces in Electromagnetics," by P. S. Kildal, IEEE Transactions on Antennas and Propagation, vol. 38, No. 10, (Oct. 1, 1990) (pp. 1537-1544).

(Continued)

*Primary Examiner* — Tan Ho
(74) *Attorney, Agent, or Firm* — Proskauer Rose LLP

(57) ABSTRACT

Described is an apparatus and method for reducing noise in an information bearing signal is provided. A feeding element receives dual-polarized wideband electromagnetic signals. The feeding element is coupled to a Non-Cutoff Frequency Selective Surface ground plane. The Non-Cutoff Frequency Selective Surface ground plane allows for a line-of-sight signal and a surface wave to cancel. The Non-Cutoff Frequency Selective Surface ground plane can be a metal plate with a plurality of corrugations. The corrugations can be concentric rings, each corrugation having a predetermined height and a predetermined spacing from adjacent corrugations.

8 Claims, 5 Drawing Sheets

OTHER PUBLICATIONS

"Scattering by a Rectangularly Corrugated Surface: An Approximate Theory," by G. A. Kriegsmann et al., IEEE Transactions on Antennas and Propagation, vol. 44, No. 8, (Aug. 1996) (pp. 1193-1194).
"High-Impedance Electromagnetic Surfaces with a Forbidden Frequency Band," by D. Sievenpiper et al., IEEE Transactions on Microwave Theory and Techniques, vol. 47, (Nov. 1999) (pp. 2059-2074).
"A Uniform Geometrical Theory of diffraction for an edge in a Perfectly Conducting Surface," by R. G. Kouyoumjian et al., Proceedings of the IEEE, vol. 62, No. 11, (Nov. 1974) (pp. 1148-1461).
"Study of Different Realizations and Calculation Models for Soft Surfaces by Using a Vertical Monopole on a Soft Disk as a Test Bed,", by Z. Ying et al., IEEE Transactions on Antennas and Propagation, vol. 44, No. 11, (Nov. 1996) (pp. 1474-1481).
"The Control of the Echo Area of Ogives by Cutoff Corrugated Surfaces," by R. E. Lawrie et al., IEEE Transactions on Antennas and Propagation, vol. 14, No. 6, (Nov. 1966) (pp. 798-799).
"Properties of Cutoff Corrugated Surfaces for Corrugated Horn Design," by C. A. Mentzer et al., IEEE Transactions on Antennas and Propagation, vol. AP-22, No. 2. (Mar. 1974) (pp. 191-196).
"Frequency-Independence and Symmetry Properties of Corrugated Conical Horn Antennas with Small Flare Angles", by M E J Jeuken, Ph.D. Dissertation, Eindhoven University, The Netherlands (Sep. 8, 1970) (pp. 1-148).
"Multi-Frequency Band Corrugated Conical Horn Antenna," by M. E. J. Jeuken et al. 3rd European Microwave Conference, 1973, vol. 2, (Oct. 1973) (pp. 1-4).
"The Corrugated Elliptical Horn Antenna," by M.E. J. Jeuken et al., IEEE Antennas and Propagation Society International Symposium, vol. 13, (Jun. 1975) (pp. 9-120).
"Design Realization and measurements of a High performance Wide-Band Corrugated Horn," by Y. Beniguel et al., IEEE Transactions on antennas and Propagation, vol. 53, No. 11, (Nov. 2005) (pp. 3540-3546).
"Modifications of Horn Antennas for Low Sidelobe Levels," by R. E. Lawrie et al., IEEE Transactions on Antennas and Propagation. vol. AP-41, No. 5, (Sep. 1966) (pp. 605-610).
"Multipath-Rejecting GPS Antennas," by C. C. Counselman, III, Proceedings of the IEEE, vol. 87, No. 1 (Jan. 1999) (pp. 86-91).
"Analysis of a Choke Ring Groundplane for Multipath Control in Global Positioning System (GPS) Applications," by J. M. Tranquilla et al., IEEE transactions on Antennas and Propagation, vol. 42, No. 7 (Jul. 1994) (pp. 905-911).
"Development of a Class of Antennas for Space-Based NAVSTAR GPS Applications," by J. M. Tranquilla et al., University of New Brunswick, Canada (Apr. 1989) (pp. 65-69).
"Comparative Study of High Performance GPS Receiving Antenna Designs," by J. I. Ortigosa et al., IEEE AP-S International Symposium, (Jul. 1996) (pp. 1958-1961).
"Optimization of Ground Plane for Improved GPS Antenna Performance," by T. Milligan et al., IEEE AP-S International Symposium, vol. 2. (Jul. 1996) (pp. 1230-1253).
"A Three Dimensional Choke Ring Ground Plane Antenna," by W. Kunysz, NovAtel Inc. (2003) (6 pgs.).
"Measured Characteristics of Dual Depth Dual Frequency Choke Ring for Multipath Rejection in GPS Receivers," by V. Philippov et al., Javad Positioning Systems, (1999) (4 pgs.).
"GPS Antenna Multipath Rejection Performance," by A. -M. Dinius, Massachusetts Institute of Technology Lincoln Laboratory, Cambridge, MA, Project Report ATC-238, vol. 70, (Aug. 7, 1995) (p. iii-57).
"Diffraction at Artificially Soft and Hard Edges by Using Incremental Theory of Diffraction," by S. Maci et al., IEEE AP-S International Symposium, vol. 3, (Jun. 1994) (pp. 1464-1467).
"A Broadband Rolled Edged Cavity Antenna," by D. E. Ping, The Aerospace Corporation, IEEE AP-S International Symposium, vol. 1, (Jun. 2004) (pp. 757-790).
"A Circularly Polarized Crossed Drooping Dipole Antenna," by M. S. Gatti et al, IEEE AP-S International Symposium, vol. 1, (May 1990) (pp. 254-257).
"A Comparative Study of a New GPS Reduced-Surface-Wave Antenna," by L. I. Basilio et al., IEEE Antennas and Wireless Propagation Letters, vol. 4, (2005) (pp. 233-236).
"Multi-band $L_5$—Capable GPS Antenna with Reduced Backlobes," by Y. Lee et al., IEEE AP-S International Symposium, vol. 1A, (Jul. 2005) (pp. 438-441).
"High Performance GPS Pinwheel Antenna," by W. Kunysz, NoyAtel Inc. (2000) (6 pgs.).
A Wideband Planar Dipole Antenna for Use in the Long Wavelength Demonstrator Array (LWDA,) by A. Kerkhoff et al., IEEE AP-S International Symposium, vol. 1B, (Jul. 2005) (pp. 553-556).
"Comparison of Two Candidate Elements for a 30-90 Mhz Radio Telescope Array," by Ellingson et al., IEEE AP-S International Symposium, vol. 1A, (Jul. 2005) (pp. 590-593).
"Time-Harmonic Electromagnetic Fields," by R. F. Harrington, McGraw Hill, New York, 1961, (pp. 170-171).
"Antenna Theory. Analysis and Design," by C. A. Balanis, Wiley, New York, 2005 3rd ed., (pp. 785-791).
"Microwave Engineering," by D. M. Pozar, Wiley, New York, 2005, third edition (pp. 670-674).
"Corrugated Horns for Microwave Antennas," by P. J. B. Clarricoats et al., Perter Peregrinus Ltd., London, UK, 1984. (Chapter 3).
"Signal characteristics of GPS user antennas," by B. R. Schupler, et al., Navigation: J. Inst. Navigation (ION), vol. 41, No. 3, Fall 1994, (pp. 277-295).
"Geodesy using the global positioning system: The effects of signal scattering on estimates of site position," by P. El'osegui et al., J. Geophys. Res., vol. 100. No. B7, (Jun. 10, 1995) (pp. 9921-9934).
"High Accuracy Characterization of Geodetic GPS Antennas Using Anechoic Chamber and Field Tests," by B. R. Schupler et al., 13th International Technical Meeting of the Satellite Division of the Institute of Navigation (ION), Salt Lake City, (Sep. 20, 2000) 7pgs.
"Modern Antenna Design," by T. A. Milligan, Wiley-IEEE Press, New York, 2005 2nd edition. (Chapter 5, pp. 217-284, and Chapter 10, pp. 474-520).

* cited by examiner

NON-CUTOFF FREQUENCY SELECTIVE SURFACE GROUND PLANE ANTENNA ASSEMBLY

CROSS REFERENCE TO RELATED APPLICATIONS

This application is a continuation of U.S. patent application Ser. No. 12/212,065 filed Sep. 17, 2008, which claims the benefit of and priority to U.S. Provisional Patent Application No. 60/973,025, filed Sep. 17, 2007, both of which are owned by the assignee of the instant application and the disclosures of which are incorporated herein by reference in their entireties.

GOVERNMENT RIGHTS

The technology described herein was developed with funding provided by the National Science Foundation, contract number DMI-0450524, PSI-7225-010. The federal government may have rights in the technology.

FIELD OF THE INVENTION

The invention relates generally to a method and apparatus for shaping a signal pattern. In one embodiment, the invention relates to wideband antenna with a Non-Cutoff Frequency Selective Surface ground plane.

BACKGROUND OF THE INVENTION

Positioning and navigation systems can require an antenna that has high-accuracy and operates over multiple frequencies. FIG. 1 is a graph of operational frequencies for exemplary positioning and navigation systems. Modernized GPS System antennas and receivers operate along three bands, 1563 to 1578 MHz (L1), 1216 to 1240 MHz (L2), and 1164 to 1188 MHz (L3). A GPS system to be deployed is GALILEO. Although the exact bands of operation for GALILEO are unknown, it is anticipated that GALILEO will operate along five bands, 1165 to 1216 MHz (E5a and E5b), 1215 to 1237 MHz (E2), 1260 to 1300 MHz (E6), and 1563 to 1587 MHz (E1). Positioning and navigations systems can require frequency operation between 1.15 and 1.60 GHz band.

Positioning and navigation systems can also require elimination of multipath signal reflections. FIG. 2 is a diagram of an example of a positioning system. The positioning system includes two transmitting GPS systems 202*a*, 202*b* and one GPS receiver 204. Multipath signal reflections 206*a*, 206*b*, 206*c*, 206*d*, generally 206, are reflected from ground 208, a building 210, a tree 212 and an antenna 214. The multipath signal reflections 206 interfere with an information signal 216*a*, 216*b* (i.e., the primary direct line-of-sight signal) from the two transmitting GPS systems 202*a*, 202*b*. The multipath signal reflections 206 reduce accuracy of the position data.

Axial-ratio is one measure of multipath signal rejection capability for Right Hand Cross Polarized (RHCP) antennas, such as GPS antennas. Multipath signals are primarily Left Hand Cross Polarized (LHCP) reflection signals from objects located within a close proximity to the antenna. Current high accuracy GPS antennas feature an axial-ratio bandwidth that is too narrow to cover frequencies between 1.15 and 1.60 GHz Current antenna systems can eliminate multipath signal reflections and achieve sufficient antenna performance for two bands, L1 and L2, using for example, GPS antennas equipped with choke ring ground planes. The choke ring ground plane efficiently mitigates multipath signal reflections at L1 and L2 by eliminating propagation of surface wave on the ground plane and thereby suppressing undesired multipath signals at low elevation angles. The choke ring ground plane enhances antenna performance by reducing back lobe and side lobe radiation that also improves multipath signal reflection mitigation.

Plane waves and surface waves that travel on a finite sized non-corrugated metal ground plane radiate causing ground plane edge diffraction, thus increasing back lobe and side lobe radiation. A choke ring is a corrugated surface having deep metal concentric rings. Corrugated surfaces do not support propagation of plane waves. Consequently, choke rings to do not support propagation of plane waves. Moreover, for a choke ring to ensure the absence of propagation of surface waves the corrugation depth (i.e. concentric rings) d, must be $\lambda/4 \leqq d \leqq \lambda/2$, for each frequency of operation (operation at cutoff). The absence of propagation of surface waves eliminates the antenna back lobes and side lobes, thus preventing reception of multipath signals at low elevation angles. For a dual-frequency, L1 and L2, GPS antenna to operate with surface wave cutoff, the corrugation depth is typically between 61 mm$\leqq$d$\leqq$95 mm and the diameter of the choke ring is typically approximately 360 mm.

Current high accuracy antennas cannot support frequencies over the entire range of 1.15 to 1.60 GHz.

SUMMARY OF THE INVENTION

In one aspect, the invention features an antenna having a feeding element capable of receiving dual-polarized wideband electromagnetic signals and a Non-Cutoff Frequency Selective Surface ground plane. The Non-Cutoff Frequency Selective Surface ground plane has a metal plate with a plurality of corrugations, such as concentric rings, each corrugation having a predetermined height and a predetermined spacing from adjacent corrugations to cause a line-of-sight signal and a surface wave signal to cancel.

In some embodiments, the Non-Cutoff Frequency Selective Surface causes multipath signal rejection for a multipath signal with a low or negative elevation angle. In some embodiments, the antenna receives the electromagnetic signals within a bandwidth of 1.15 GHz to 1.60 GHz. In some embodiments, the Non-Cutoff Frequency Selective Surface ground plane is a choke ring.

In some embodiments, the corrugation depth range is less than $\lambda/4$. In some embodiments, the edges of the choke ring are rolled. In some embodiments, the feeding element is a droopy turnstile bowtie. In some embodiments, the droopy turnstile bowtie has a droop angle between 30 and 45 degrees. In some embodiments, the Non-Cutoff Frequency Selective Surface causes elimination of edge diffraction.

In another aspect, the invention is a signal pattern shaping method. The method involves controlling phase of a surface wave propagating on a surface of a Non-Cutoff Frequency Selective Surface ground plane having a geometry that tunes the surface waves phase to be a multiple of $\pi$ relative to phase of a line-of-sight signal. The method also involves canceling a low elevation signal that is the composition of a surface wave and a line-of-sight signal having a phase difference tuned to be a multiple of $\pi$.

In some embodiments, the method involves rejecting a multipath signal having a low or negative elevation angle. In some embodiments, the method involves receiving signals within a bandwidth of 1.15 GHz to 1.60 GHz. In some embodiments, the method involves receiving signals with a droopy turnstile bowtie. In some embodiments, the droopy turnstile bowtie has a droop angle between 30 and 45 degrees.

In some embodiments, the Non-Cutoff Frequency Selective Surface ground plane includes geometry of a choke ring. In some embodiments, the corrugation depth is less than λ/4. In some embodiments, the edges of the choke ring are rolled. In some embodiments, the method involves elimination of edge diffraction.

DETAILED DESCRIPTION

Figure 1:
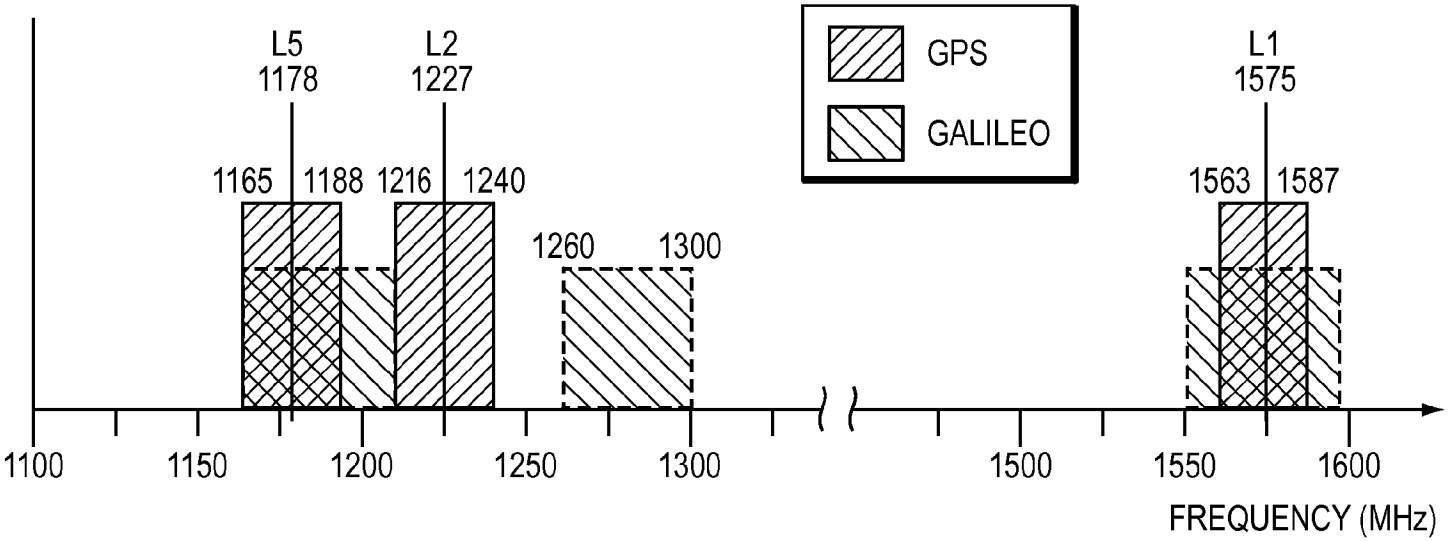
FIG. 1 is a graph of operational frequencies for known positioning and predicted navigation systems.
Figure 2:
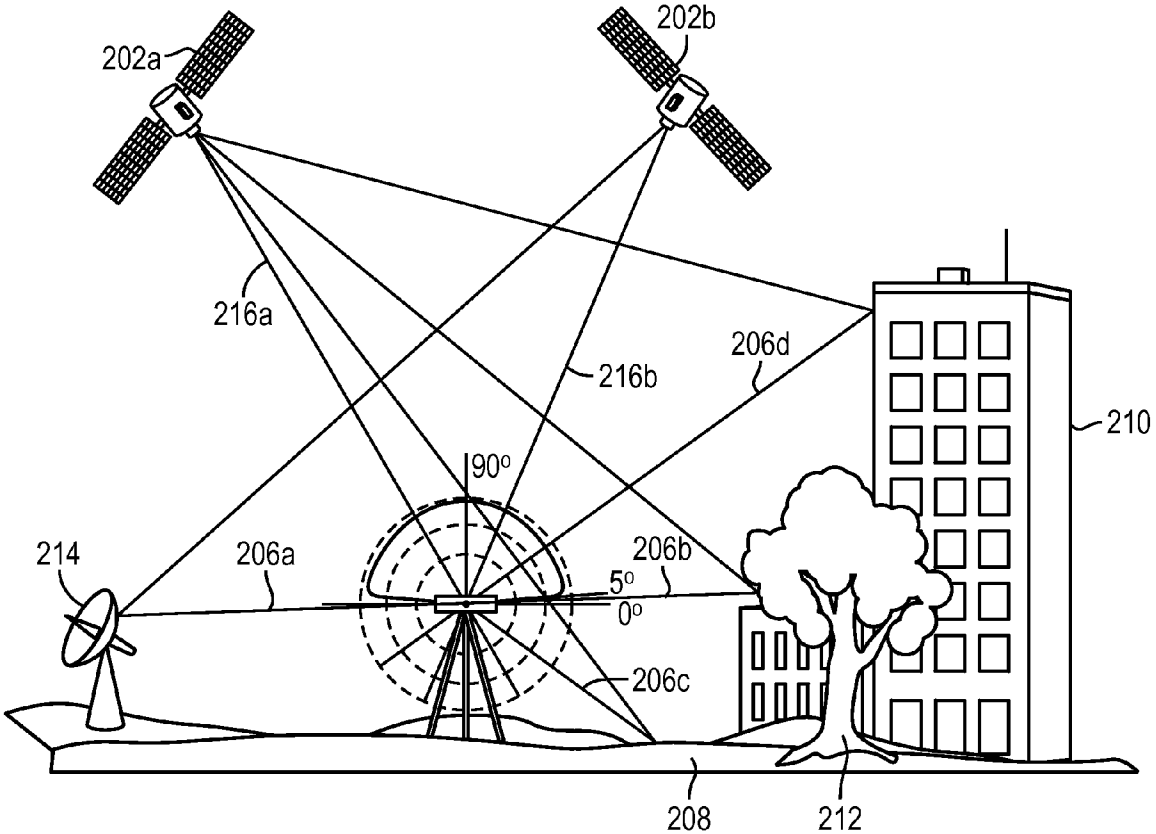
FIG. 2 is a diagram of an example of multipath signals for a known positioning system.
Figure 3A:
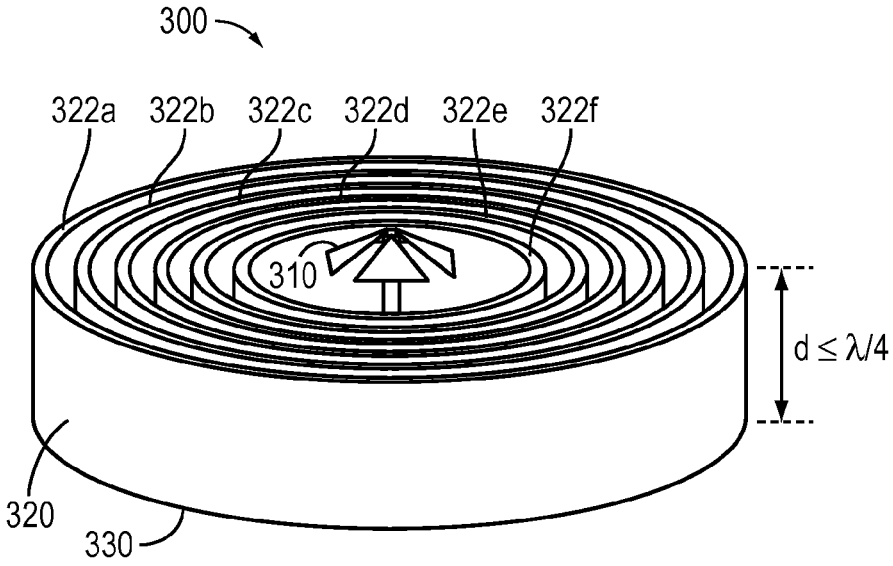
FIG. 3A is a three-dimensional view of an antenna including a Non-Cutoff Frequency Selective Surface (FSS) ground plane in accordance with one embodiment of the invention.

FIG. 3A is a three-dimensional view of an antenna including a Non-Cutoff Frequency Selective Surface (FSS) ground plane in accordance with one embodiment of the present invention. The antenna 300 includes a droopy turnstile bowtie feeding element 310, a single balun (not shown) and a Non-Cutoff FSS ground plane 320. The droopy turnstile bowtie feeding element 310 receives electromagnetic signals that propagate through the single balun to the Non-Cutoff FSS ground plane 320. The Non-Cutoff FSS ground plane 320 has a corrugation depth, d, that is less than λ/4.

Figure 3B:
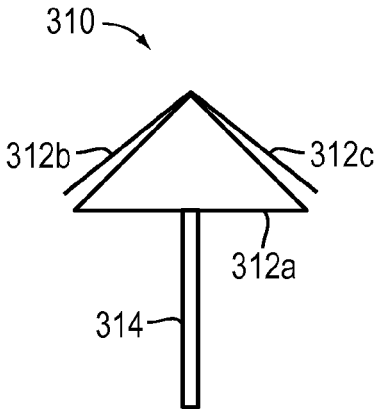
FIG. 3B is a drawing of a droopy turnstile bowtie feeding element.

FIG. 3B is a drawing of a droopy turnstile bowtie feeding element. The droopy turnstile bowtie feeding element 310 has multiple flaps 312*a*, 312*b* and 312*c* connected to a vertical member 314. The vertical member 314 connects to the single balun. The droopy turnstile bowtie feeding element 310 increases the antenna's impedance bandwidth and improves Right Hand Cross Polarization (RHCP) gain of the antenna 300 close to the horizon. The droopy turnstile bowtie feeding element 310 can have a droop angle between 30 and 45 degrees. The droopy turnstile bowtie feeding element 310 can be other types of feeding elements. For example, the droopy turnstile bowtie feeding element 310 can be a turnstile dipole, a vertical dipole, a whip, a L-antenna, a dish, a dish cone, a cross-antenna, or any type of feeding element.

Figure 4:
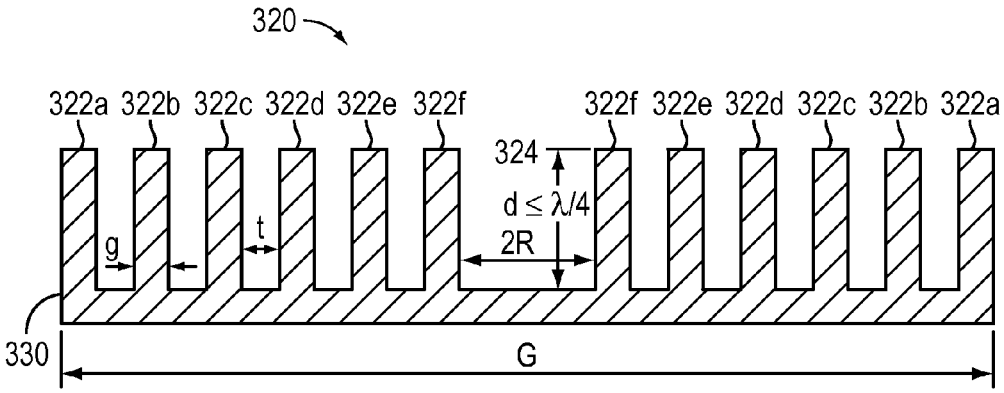
FIG. 4 is a cross-sectional view a Non-Cutoff FSS ground plane.

FIG. 4 is a cross-sectional view a Non-Cutoff FSS ground plane. The Non-Cutoff FSS ground plane 320 includes corrugations 322*a*, 322*b*, 322*c*, 322*d*, 322*e*, 322*f*, generally 322, connected to a flat ground plane 330. The corrugations 322 have a depth, d, that is less than λ/4. The corrugation depth is the distance between a top edge 324 of the corrugations and the flat ground plane 330. Since the Non-Cutoff FSS ground plane 320 includes corrugations 322, the Non-Cutoff FSS ground plane 320 does not support propagation of plane waves. The Non-Cutoff FSS ground plane 320 allows surface waves to propagate and controls the propagation of surface wave rather than cutting off the surface wave, as done in the prior art. The Non-Cutoff FSS ground plane 320 does support surface wave propagation because it has a corrugation depth of $d<\lambda/4$ that allows the propagation of surface waves. An information containing signal is composed of a line-of-sight signal. A multipath signal reflection with a low or negative elevation signal is the composition of the line-of-sight signal and the surface wave signal. A line-of-sight signal propagates along side the Non-Cutoff FSS ground plane 320 with the same magnitude as the surface wave propagates through the Non-Cutoff FSS ground plane 320. The surface wave signal is tuned by the Non-Cutoff FSS ground plane's optimized geometry to be 180 degrees (π) out of phase with the line-of-sight signal thus causing destructive interference, cancelling the surface wave and the line-of-sight signal. Thus, the multipath signal reflection is cancelled leaving only the information bearing signal. In addition, edge diffraction is removed, there are no back lobes and side lobes in the antenna 300 pattern close the horizon and multipath reception is eliminated. Instead of using an operation at cutoff ($\lambda/4 \leqq d \leqq \lambda/2$) to eliminate the surface wave as in the prior art (e.g., choke ring antennas) the surface wave propagation is controlled by the corrugation geometry of corrugation depth of $d<\lambda/4$.

The corrugation depth can be in the range of d<16 to 25 mm to achieve the surface wave and line-of-sight signal cancellation in the band 1.15 to 1.60 GHz. In some embodiments, the number of corrugations is the rounded ratio of EQN. 1

$$N_c=[(G/2)-R]^{(g+t)} \qquad \text{EQN. 1}$$

where G is the diameter of the flat ground plane 330, R is the radius of the cavity, and g+t is the corrugation period.

In some embodiments, the corrugations are a conical shape, a frustro-conical shape, a circular shape or an oval shape. In one embodiment, the Non-Cutoff FSS ground plane has the geometry of a choke ring with rolled edges. In some embodiments, the Non-Cutoff ground plane is aluminum, brass or stainless steel.

Figure 5A:
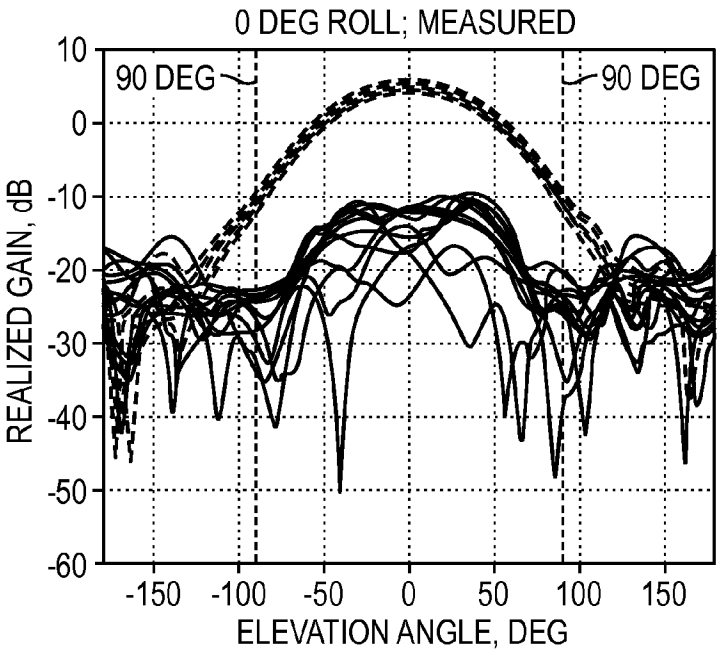
FIG. 5A is a graph of measured Right Hand Cross Polarization (RHCP) gains and Left Hand Cross Polarization (LHCP) gains for a Non-Cutoff FSS ground plane antenna with a zero degree roll angle as a function of the antenna's elevation angle.
Figure 5B:
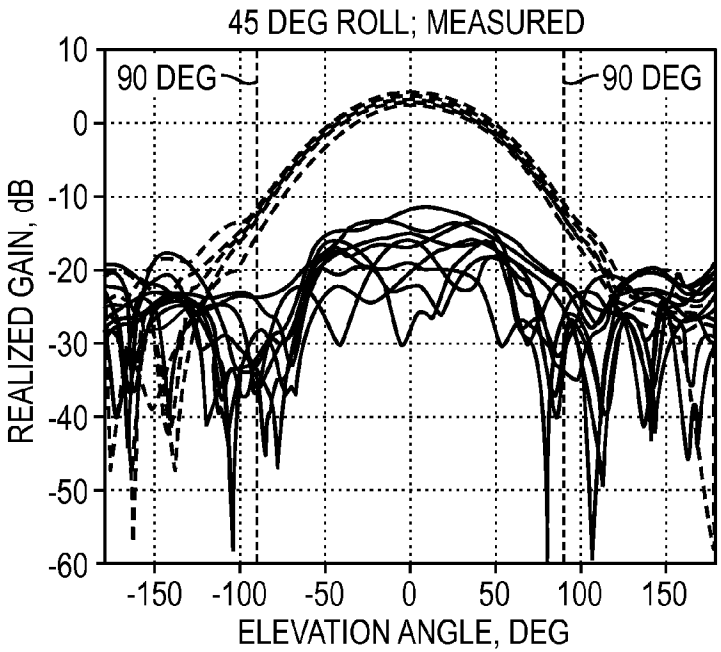
FIG. 5B is a graph of measured Right Hand Cross Polarization (RHCP) gains and Left Hand Cross Polarization (LHCP) gains for a Non-Cutoff FSS ground plane antenna with a 45 degree roll angle as a function of the antenna's elevation angle.

FIG. 5A is a graph of Right Hand Cross Polarization (RHCP) gains and Left Hand Cross Polarization (LHCP) gains for a Non-Cutoff FSS ground plane antenna with a zero degree roll angle as a function of the antenna's elevation angle. FIG. 5B is a graph of Right Hand Cross Polarization (RHCP) gains and Left Hand Cross Polarization (LHCP) gains for a Non-Cutoff FSS ground plane antenna with a forty five degree roll angle as a function of the antenna's elevation angle. For FIGS. 5A and 5B, each dashed line represents a RHCP gain corresponding to a measurement made along a frequency range of 1.15 to 1.60 GHz in 50 MHz increments. Each solid line represents a LHCP gain corresponding to a measurement made along a frequency range of 1.15 to 1.60 GHz in 50 MHz increments. The RHCP gains and LHCP gains indicate wideband performance of the Non-Cutoff FSS ground plane antenna and a high axial ratio at low elevation angles. A cross polarization ratio or an axial ratio is the ratio between RHCP and LHCP gain. A higher cross polarization ratio signifies a lower multipath signal reflection error. A lower multipath signal reflection error produces an accurate information bearing signal. An axial ratio above 10 dB indicates a good rejection of multipath signals.

While the invention has been particularly shown and described with reference to specific embodiments, it should be understood by those skilled in the art that various changes in form and detail may be made therein without departing from the spirit and scope of the invention as defined by the appended claims.

The invention claimed is:

1. An antenna comprising:

a feeding element capable of receiving dual-polarized wideband electromagnetic signals; and a Non-Cutoff Frequency Selective Surface ground plane comprising a metal plate with a plurality of corrugations that are concentric rings, each corrugation having a predetermined height and a predetermined spacing from adjacent corrugations to cause a line-of-sight signal and a surface wave signal to cancel, wherein the predetermined height is based on a wavelength of the electromagnetic signals to be received by the antenna.

2. The antenna of claim 1 wherein the Non-Cutoff Frequency Selective Surface causes multipath signal rejection for a multipath signal with a low or negative elevation angle.

3. The antenna of claim 1 wherein the antenna receives the electromagnetic signals within a bandwidth of 1.15 GHz to 1.60 GHz.

4. The antenna of claim 1 wherein the feeding element is a droopy turnstile bowtie.

5. The antenna of claim 4 wherein the droopy turnstile bowtie has a droop angle between 30 and 45 degrees.

6. The antenna of claim 1 wherein the Non-Cutoff Frequency Selective Surface causes elimination of edge diffraction.

7. The antenna of claim 1 wherein the predetermined corrugation height is less than $\lambda/4$.

8. The antenna of claim 1 wherein the Non-Cutoff Frequency Selective Surface ground plane is a choke ring.

* * * * *

UNITED STATES PATENT AND TRADEMARK OFFICE

CERTIFICATE OF CORRECTION

PATENT NO. : 8,451,190 B2
APPLICATION NO. : 13/182263
DATED : May 28, 2013
INVENTOR(S) : Sergey N. Makarov and Francesca Scire-Scappuzzo It is certified that error appears in the above-identified patent and that said Letters Patent is hereby corrected as shown below:

On Title page 2 – Other Publications item (56), two Non-patent references are incorrect.

Delete – ""Optimization of Ground Plane for Improved GPS Antenna Performance," by T. Milligan et al., IEEE AP-S International Symposium, vol. 2. (Jul. 1996) (pp. 1230-1253)."

*and replace it with*

- "Optimization of Ground Plane for Improved GPS Antenna Performance," by T. Milligan et al., IEEE AP-S International Symposium, vol. 2. (Jul. 1996) (pp. 1250-1253). -

Delete – ""A Broadband Rolled Edged Cavity Antenna," by D. E. Ping, The Aerospace Corporation, IEEE AP-S International Symposium, vol. 1, (Jun. 2004) (pp. 757-790)."

*and replace it with*

- "A Broadband Rolled Edged Cavity Antenna," by D. E. Ping, The Aerospace Corporation, IEEE AP-S International Symposium, vol. 1, (Jun. 2004) (pp. 787-790). -

Signed and Sealed this
Thirteenth Day of August, 2013

Teresa Stanek Rea
*Acting Director of the United States Patent and Trademark Office*